US006416349B1

(12) United States Patent
Lee

(10) Patent No.: US 6,416,349 B1
(45) Date of Patent: Jul. 9, 2002

(54) IDC CONNECTOR

(75) Inventor: George Lee, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/847,786

(22) Filed: May 1, 2001

(51) Int. Cl.[7] ..... H01R 4/24
(52) U.S. Cl. ..... 439/404
(58) Field of Search ..... 439/404, 405, 439/417

(56) References Cited

U.S. PATENT DOCUMENTS 5,577,930 A * 11/1996 Dahlem et al. ..... 439/399
5,762,513 A * 6/1998 Stine ..... 439/404
6,012,943 A * 1/2000 Wu ..... 439/404
6,129,574 A * 10/2000 Okayasu et al. ..... 439/404
6,220,890 B1 * 4/2001 Turek et al. ..... 439/404

* cited by examiner

*Primary Examiner*—Gary Paumen
(74) *Attorney, Agent, or Firm*—Wei Te Chung

(57) ABSTRACT

An ID connector (2) comprises a base (4), a cover (6) and a plurality of terminals (8) received in the base. The base has a mating section (10) and two posts (24). The mating section defines a receiving space (14) and a plurality of passageways (12). The base has an upper surface (23) and a pair of outer surface (26) defined at both sides thereof. The cover comprises a central portion (32) and two frames (34) positioned at both sides of the central portion. The central portion defines a slot (45) and a bottom surface (44) abutting the upper surface, and each frame defines an inner surface (38) abutting the outer surface. The terminals each have an arm (50) received in the receiving space, a body (46) received in a corresponding passageway and a fork (48) received in the slot.

1 Claim, 17 Drawing Sheets

IDC CONNECTOR

BACKGROUND OF THE INVENTION

1. Field of the Invention

The present invention relates to an Insulation Displacement Contact (hereinafter ID) connector, and particularly to an ID connector for facilitating its exact assembling.

2. Description of Related Art

U.S. Pat. No. 5,577,930 discloses an ID connector. The connector includes a housing having a plurality of grooves. Each groove receives a contact, and a pair of wings is provided in each end of the groove. Each pair of wings is spaced from and faces each other to provide a slot there between for inserting of conductors. However, the housing has complicated structure such that the connector cannot be easily assembled. Furthermore, during assembling,the ID connector lacks adequate means to press the conductors into corresponding slots, so that assistant tools are required for proper assembling. Hence, an improved ID connector is required to overcome the disadvantages of the prior art.

SUMMARY OF THE INVENTION

Accordingly, the object of the present invention is to provide an ID connector for facilitating its assembling.

In order to achieve the object set forth, an electrical connector comprises an elongated base, a cover assembled to the base and a plurality of terminals. The base has a mating section and two posts extending from the mating section to the cover. The mating section defines a receiving space and a plurality of passageways. In addition, the mating section further has a first surface between the two posts. The cover includes a central portion, two frames positioned at both sides of the central portion, and two channels between each frame and the central portion. The central portion defines a slot and a second surface abutting the first surface. The channel each receives corresponding post. Each terminal has an arm extending through corresponding passageway and received in the receiving space, a body received in a corresponding passageway and a fork received in the slot.

Other objects, advantages and novel features of the invention will become more apparent from the following detailed description when taken in conjunction with the accompanying drawings.

DETAILED DESCRIPTION OF THE INVENTION

Figure 1:
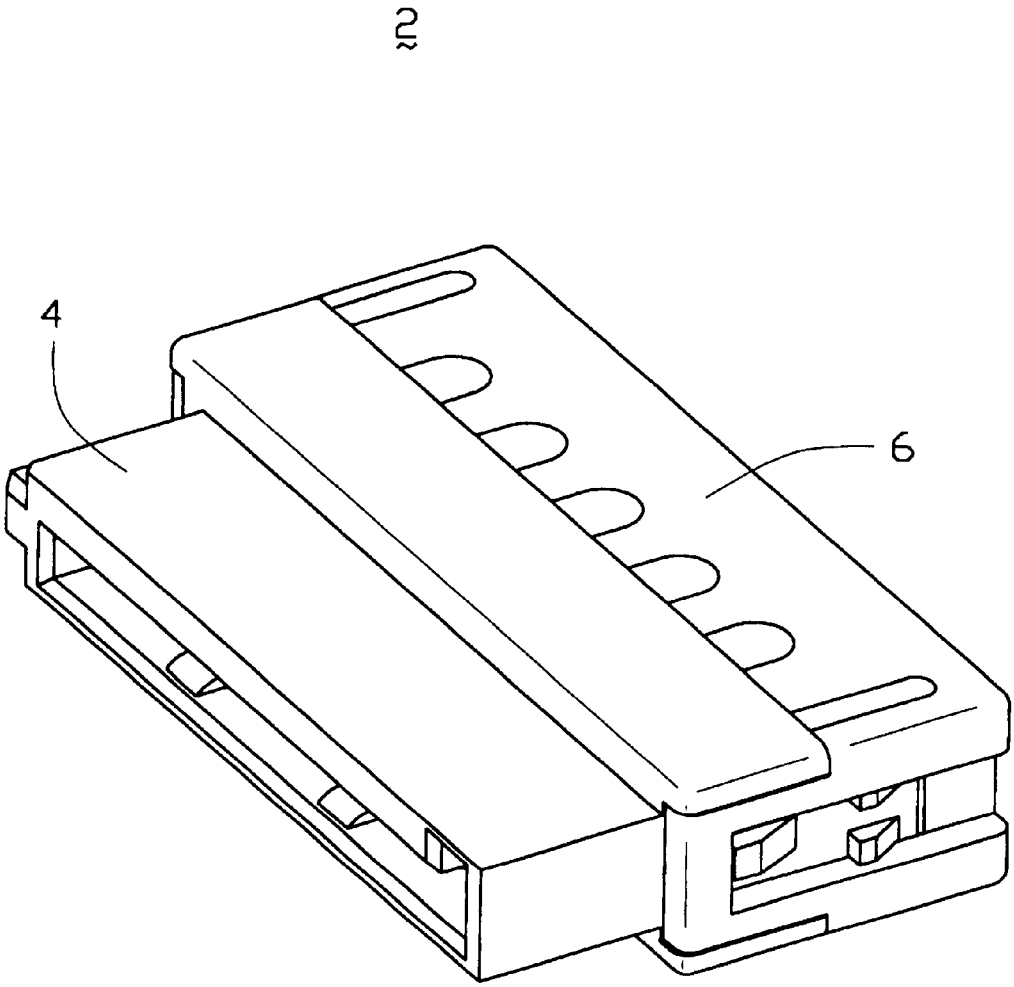
FIG. 1 is a perspective view of an ID connector in accordance with the present invention.

Reference will now be made to the drawing figures to describe the present invention in detail.

Figure 2:
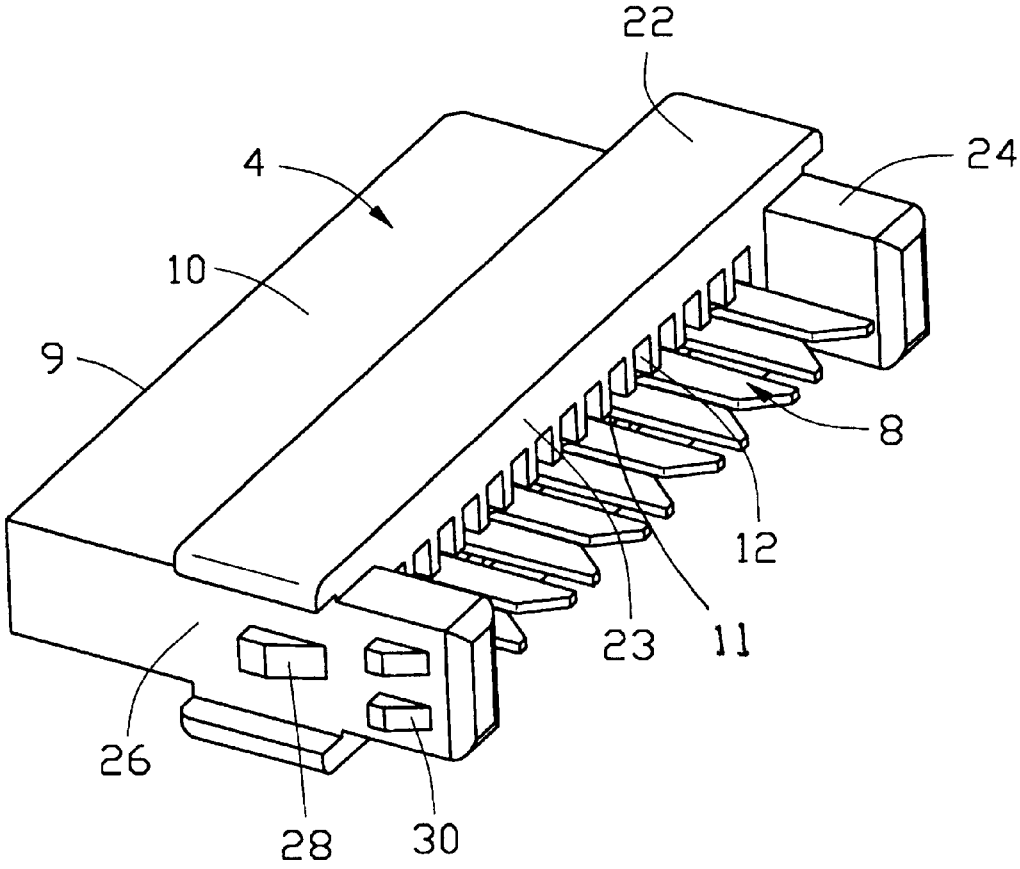
FIG. 2 is a perspective view of a base of the ID connector.
Figure 3:
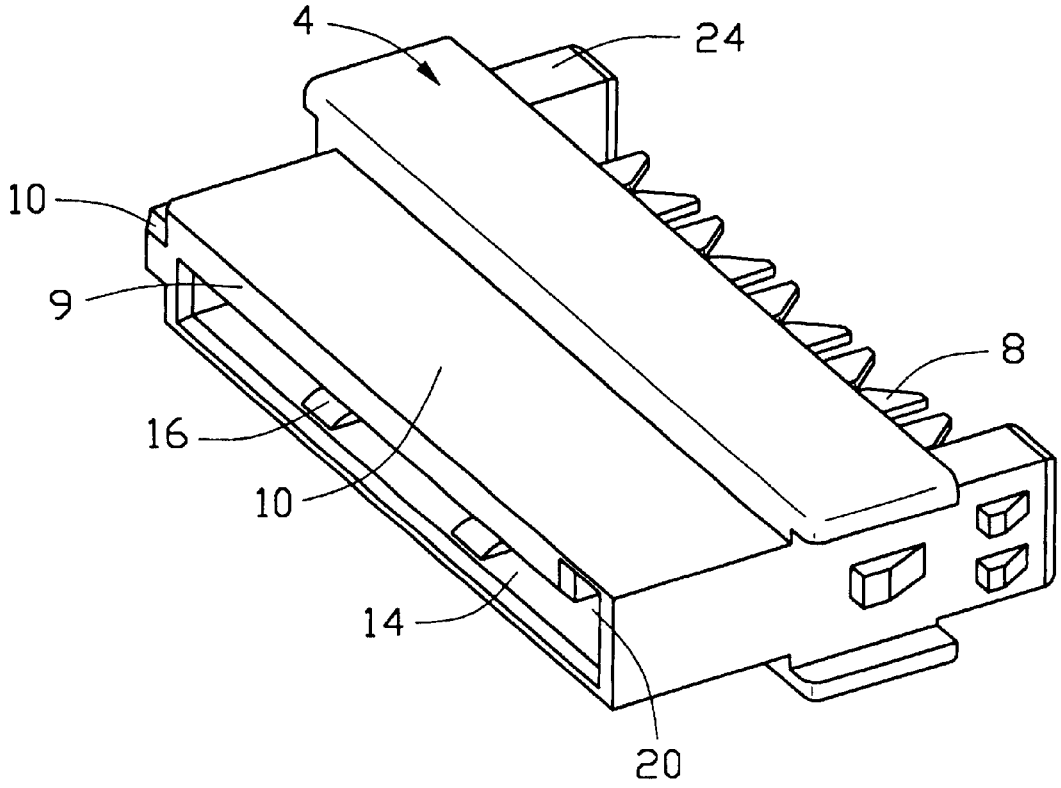
FIG. 3 is a view similar to FIG. 2 but viewed from a different angle.

Referring to FIGS. 1–3, an ID connector 2 of the present invention comprises a base 4, a cover 6 and a plurality of terminals 8 received in the base 4. The base 4 has an elongated mating section 10 defining a transverse slit 11 around a rear portion, a plurality of passageways 12 extending along a front-to-back direction, a pair of platforms 22 projecting from the mating section 10 and extending along a lengthwise direction, and a pair of posts 24 extending from the mating section 10 to the cover 6. The mating section 10 defines a mating surface 9, an upper surface 23 opposite the mating surface 9, and a receiving space 14 at a front thereof, wherein the receiving space 14 is in communication with the passageways 12. The mating section 10 has a protrusion 18 projecting from one end thereof, and a recess 20 is defined at opposite end of the mating section 10 and in communication with the receiving space 14. The designs of the protrusion 18 and the recess 20 are used to prevent mistaking with a mating connector (not shown). Adjacent to the mating surface 9, there are two blocks 16 for engaging the mating connector. The base 4 defines two outer surfaces 26 at two ends thereof, respectively, and three teeth 28 further project beyond each outer surface 26. Each tooth 28 has a leading surface 30.

Figure 4:
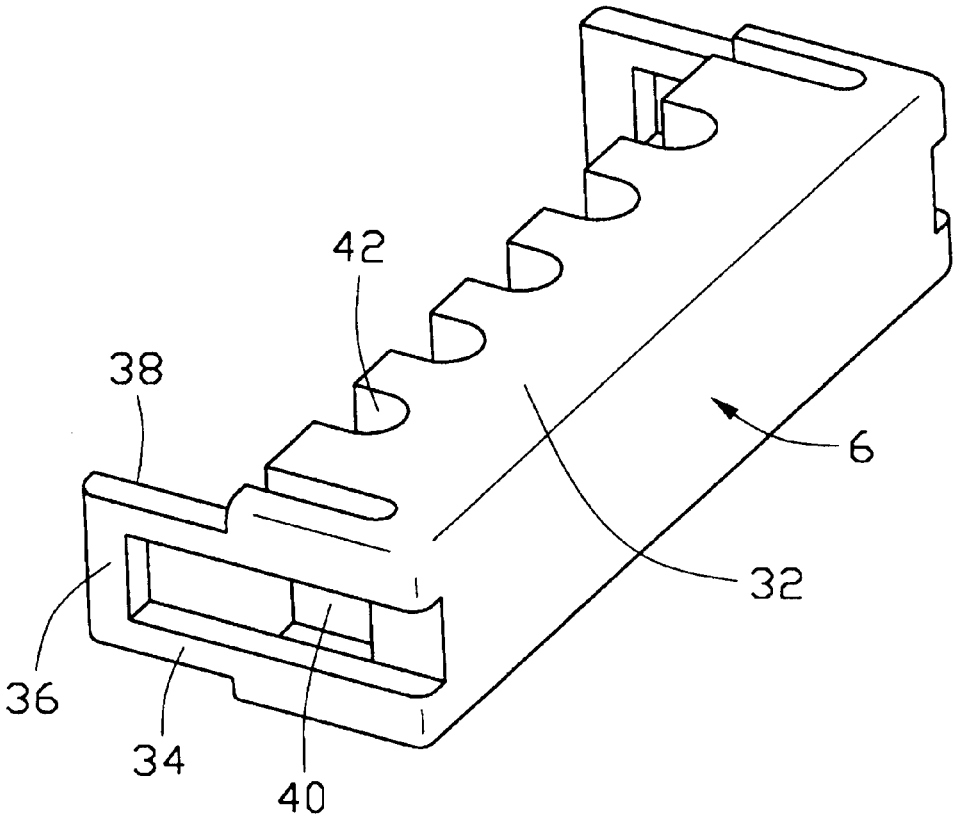
FIG. 4 is a perspective view of a cover of the ID connector.
Figure 5:
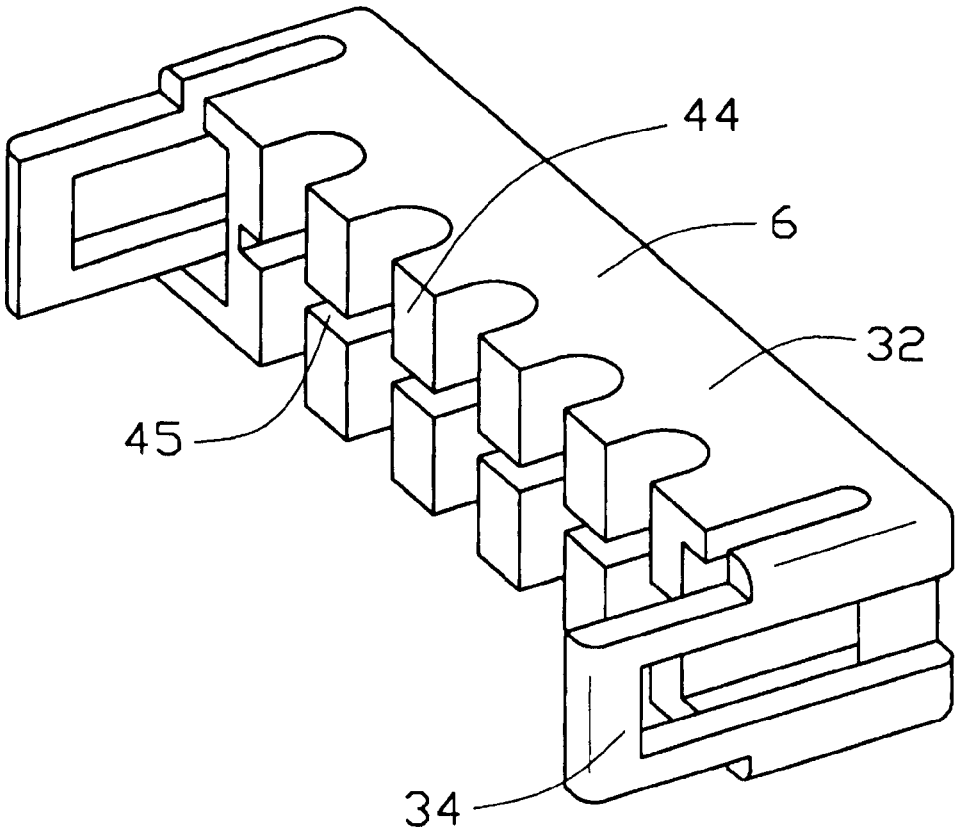
FIG. 5 is a view similar to FIG. 4 but viewed from a different angle.

Also referring to FIGS. 4 and 5, the cover 6 includes a central portion 32 and a pair of frames 34 extending from the central portion 32. The central portion 32 defines a bottom surface 44 vertical to the two frames 34, several grooves 42 extending parallel to the bottom surface 44. A slot 45 is defined in the central portion 32 and further in communication with the multiple grooves 42. A channel 40 is defined between the central portion 32 and each frame 34. The frame 34 has a front beam 36 at front end thereof and an inner surface 38 vertical to the bottom surface 44.

Figure 6:
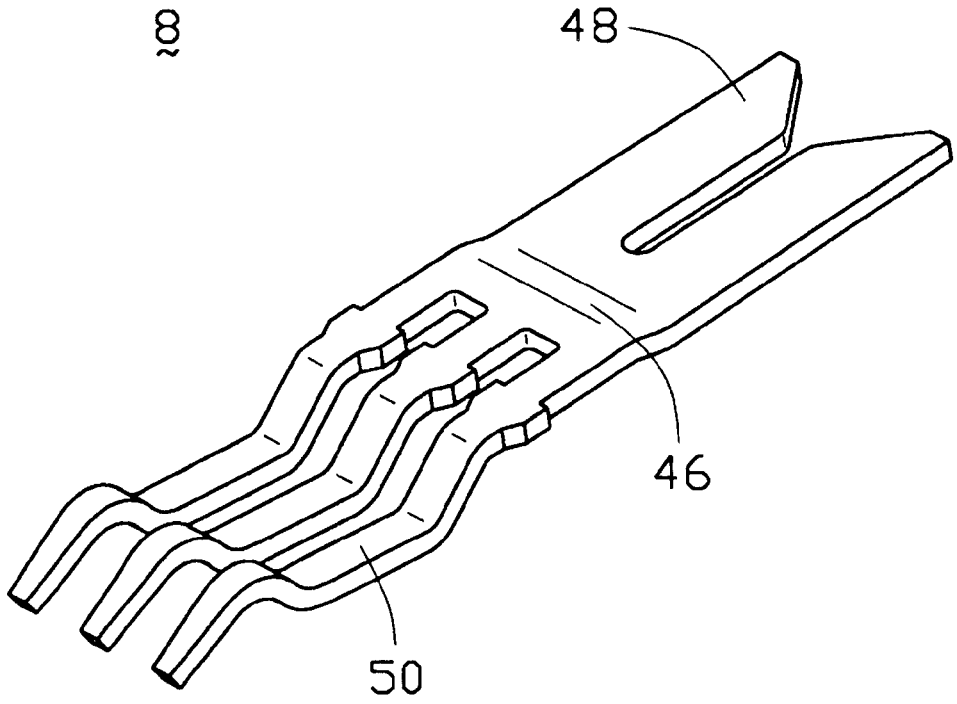
FIG. 6 is a perspective view of a terminal received in the base.
Figure 7:
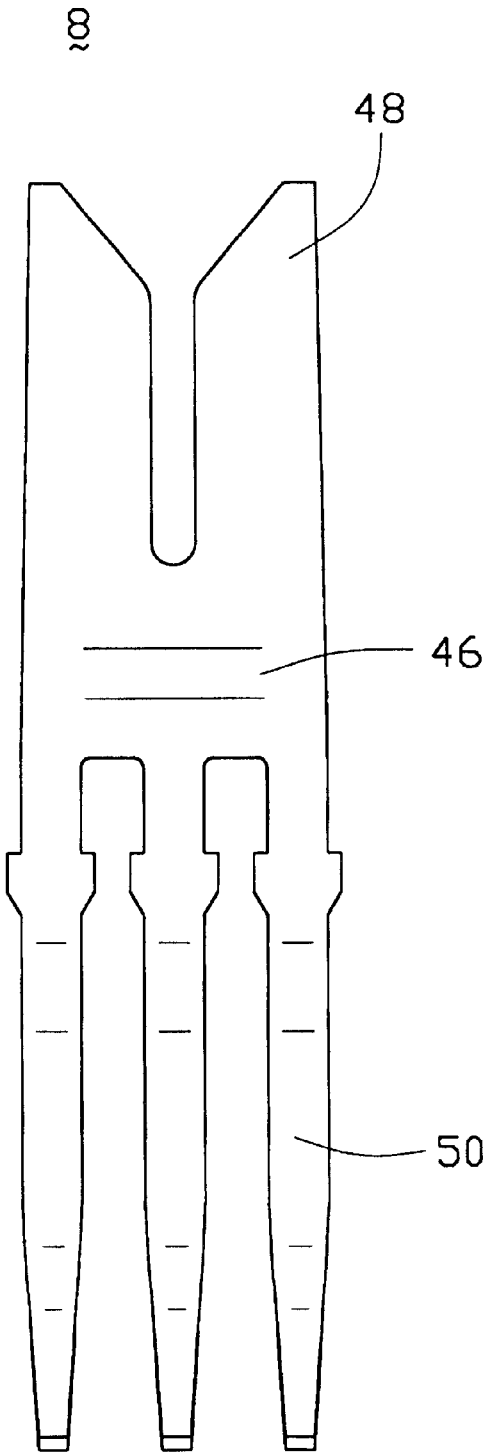
FIG. 7 is a front view of the terminal of FIG. 6.
Figure 8:
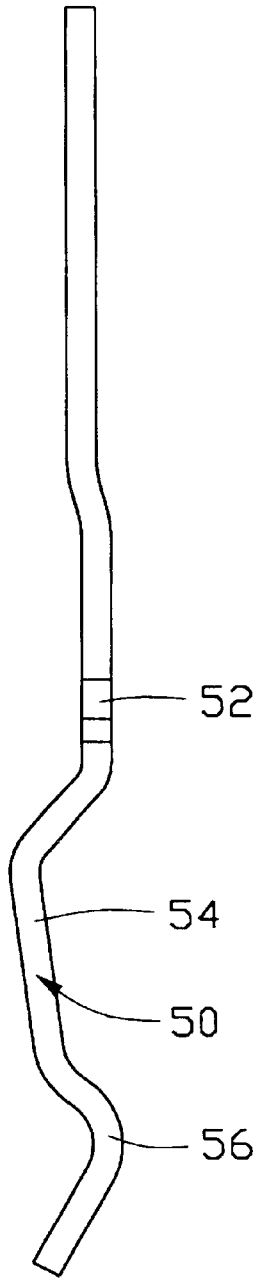
FIG. 8 is a side view of the terminal.

Referring to FIGS. 6–8, each terminal 8 includes a body 46, a pair of forks 48 and three arms 50 both extending from the body along opposite directions, wherein the forks 48 and the arms 50 have different falls respect to a surface of the body. Each arm 50 includes multiple projections 52, a connection section 54 and an V-shaped engaging section 56, respectively. Each arm 50 includes barbs for interference engagement within the corresponding passageway 12 so as to retain the corresponding terminal 8 in the base 4.

Figure 9:
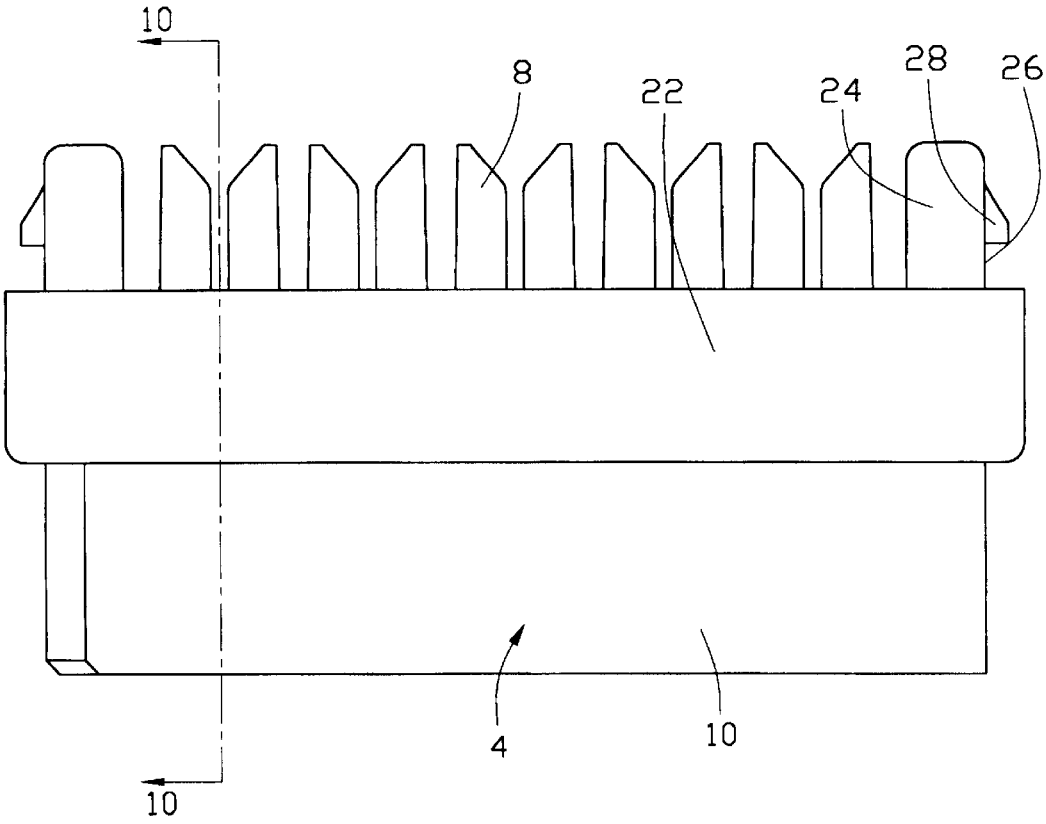
FIG. 9 is a side view of the base.
Figure 10:
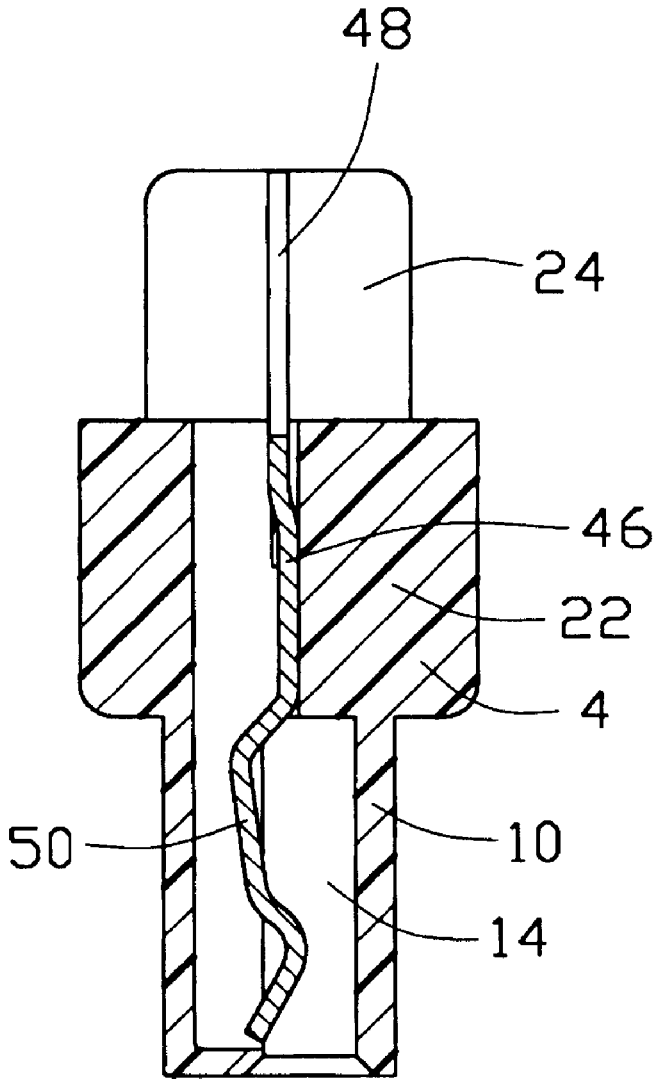
FIG. 10 is a cross-sectional view of the base taken along line 10—10 shown in FIG. 9.
Figure 11:
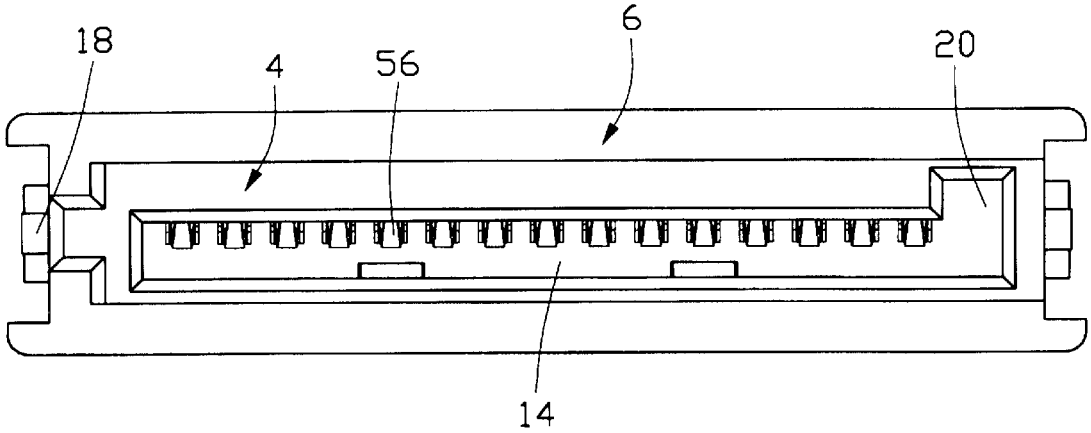
FIG. 11 is a top view of the base.
Figure 12:
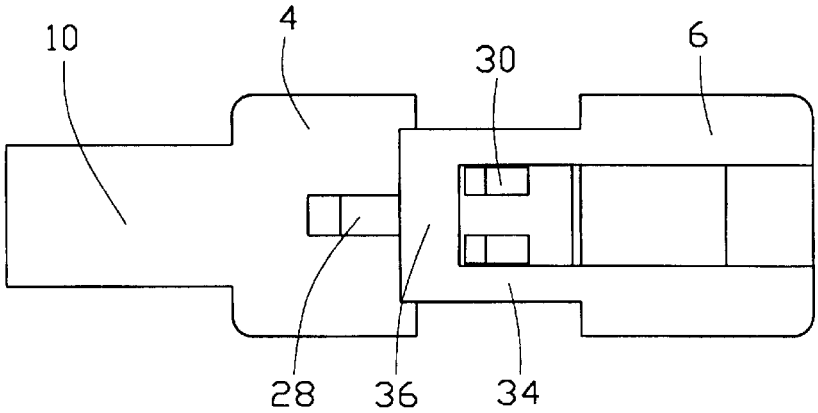
FIG. 12 is an assembling view of the ID connector to show the cover be aligned with the base.
Figure 13:
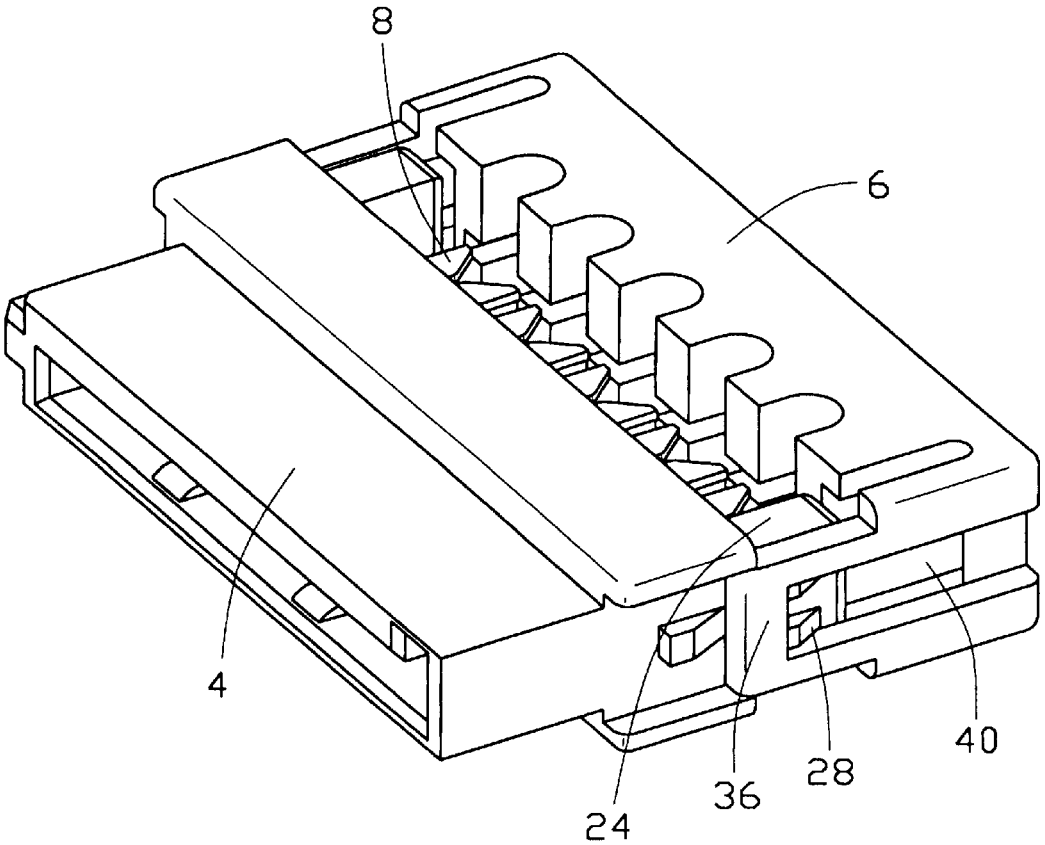
FIGS. 13–15 are views similar to FIG. 12 but viewed from others angle.
Figure 14:
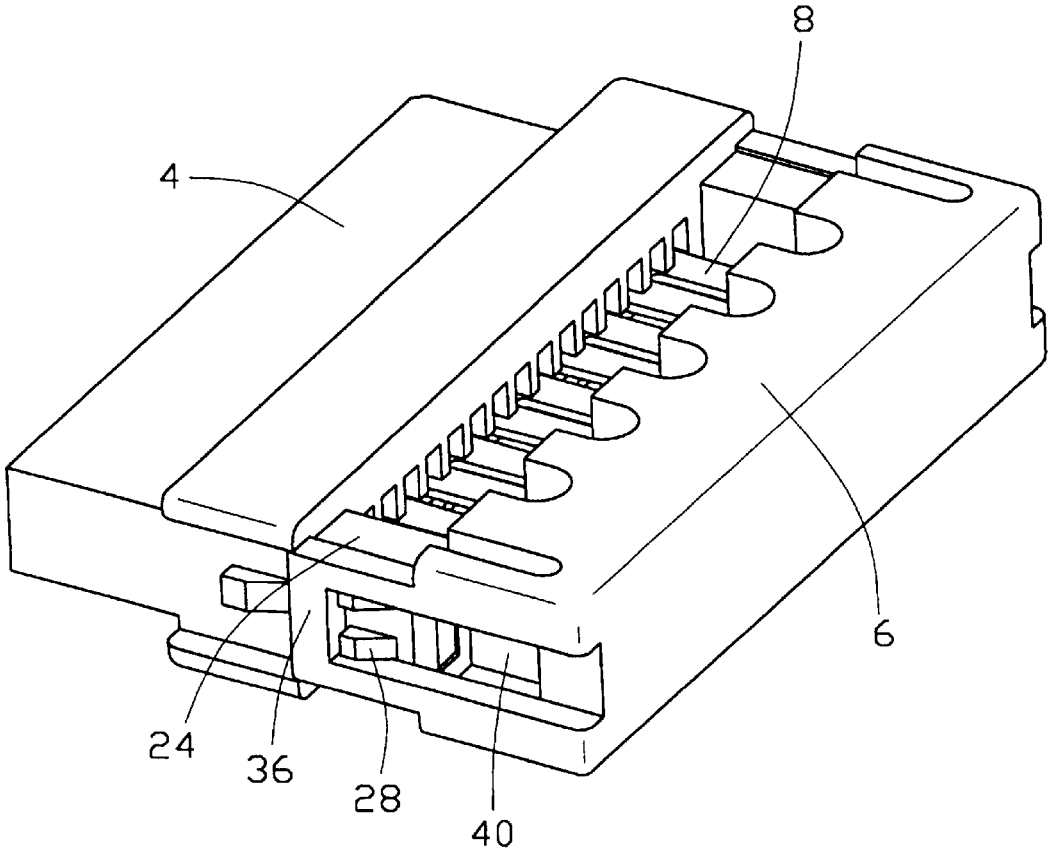
Figure 15:
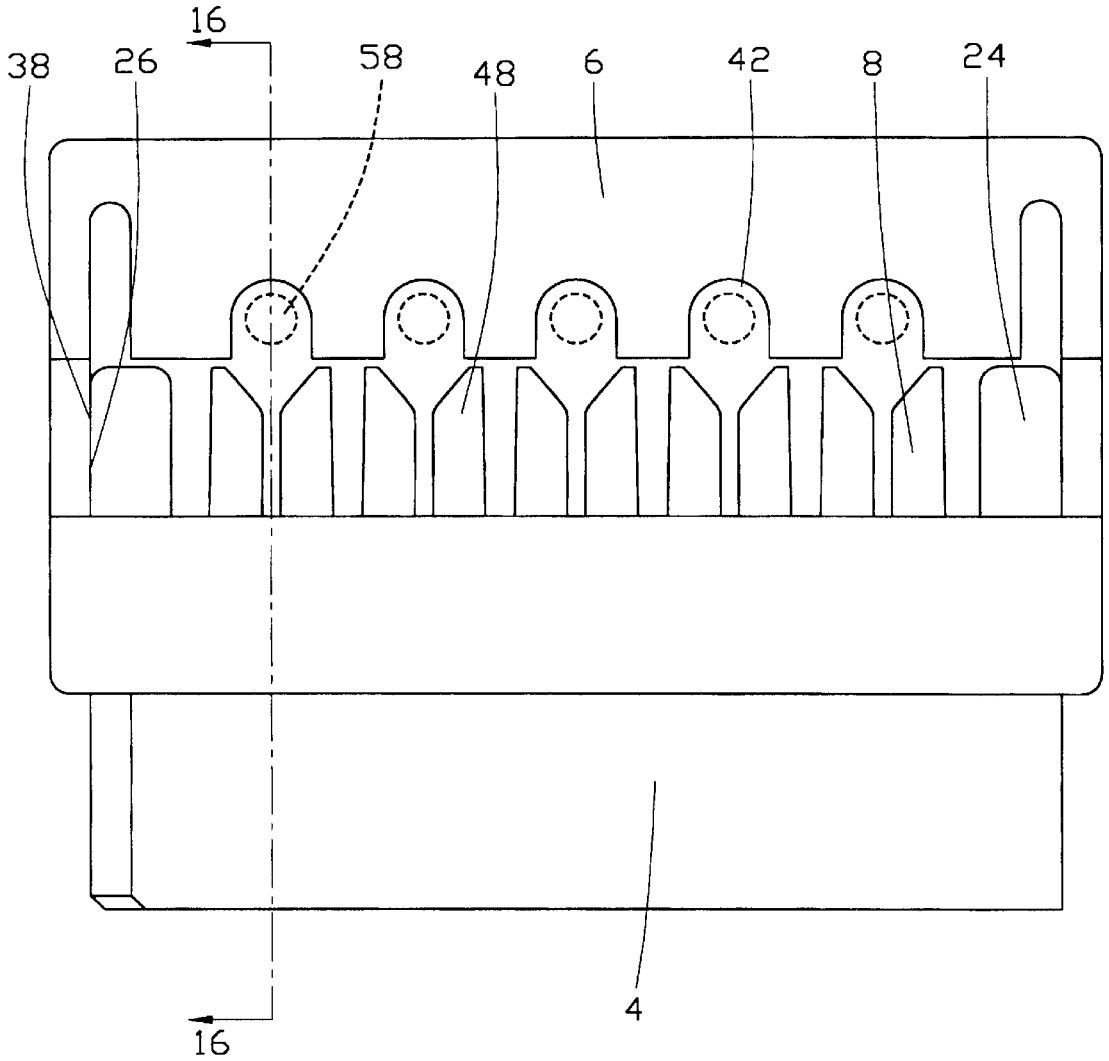
Figure 16:
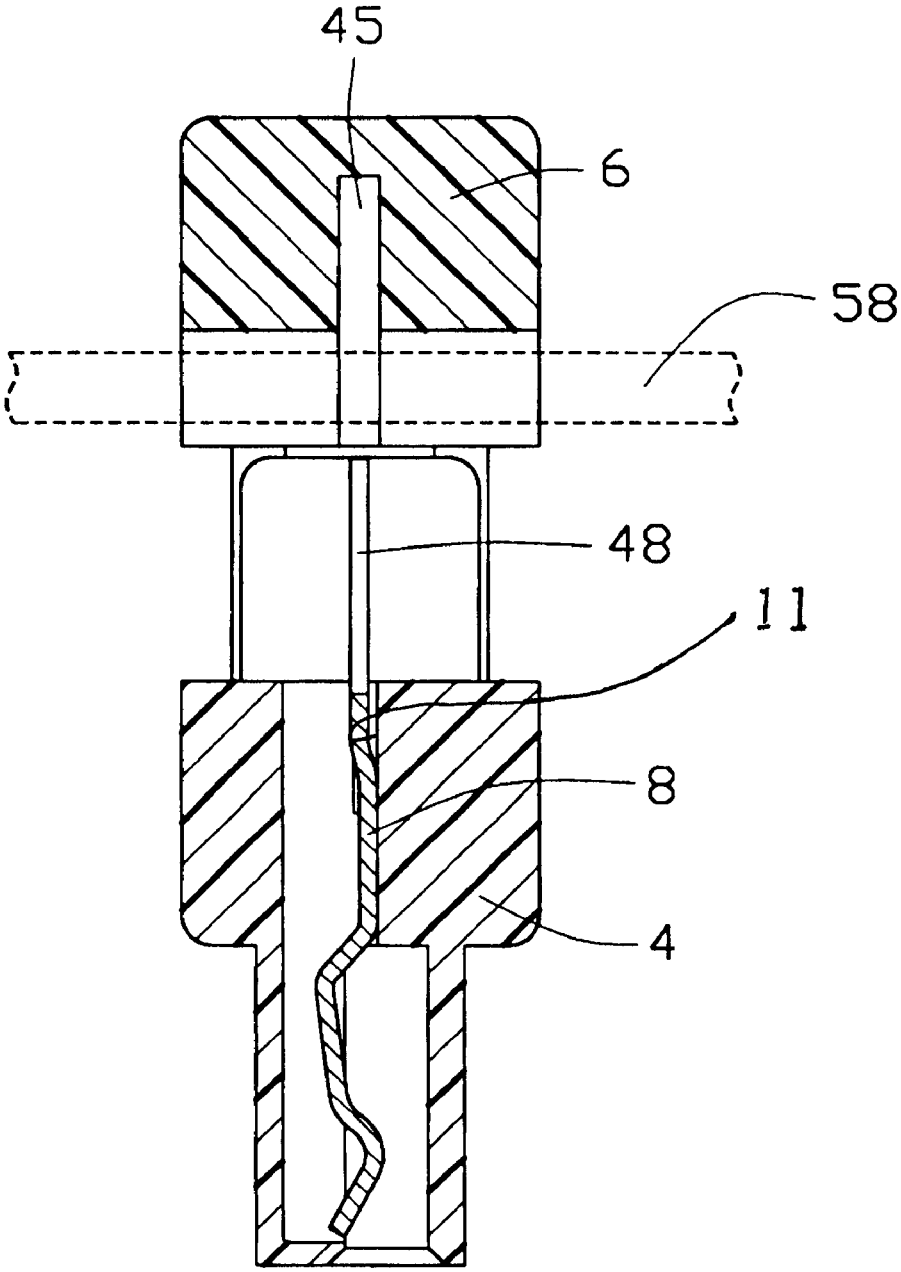
FIG. 16 is a cross-sectional view of the ID connector taken from line 16—16 shown in FIG. 15.

Referring to FIGS. 9 and 10, after the terminal 8 is inserted into the base 4, the body 46 is positioned in the transverse slit 11, the forks 48 extend rearward from the upper surface 23 and position in a same plane which is vertical to the outer surface 26 of the post 24, and the arms 50are respectively received within the corresponding passageways 12 and into the receiving space 14 of the mating section 10.

Referring to FIGS. 12–16, which show an process of assembling the cover 6 to the base 4 to form the ID connector 2. During the assembly process, the front beam 36 of the frame 34 passes across the leading surface 30 of two teeth 28, and the outer surfaces 26 slide along the inner surfaces 38, whereby the posts 24 are aligned with corresponding channels 40, and the forks 48 of the terminals 8 are aligned with the slot 45 of the cover 6. Subsequently, inserting corresponding wires 58 (as is shown in dotted-lines in FIGS. 15 and 16) through the groove 42 of the cover 6.

Figure 17:
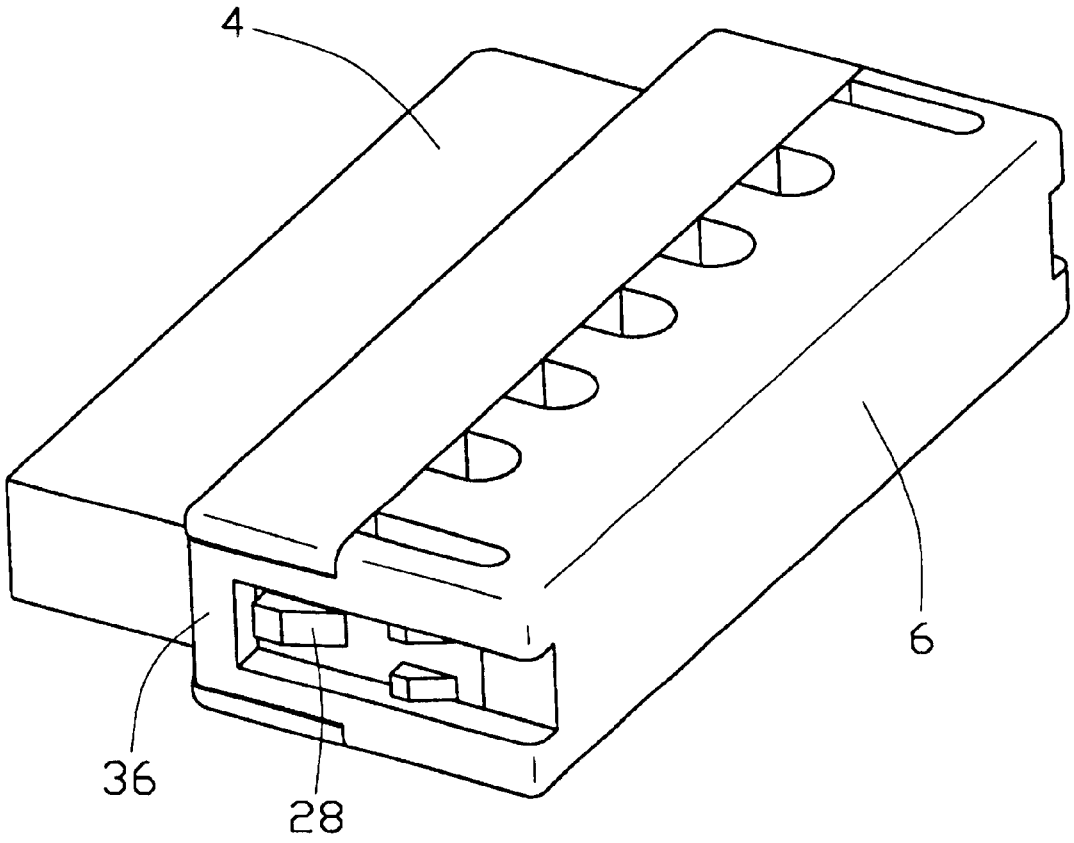
FIG. 17 is an assembled view of the ID connector.
Figure 18:
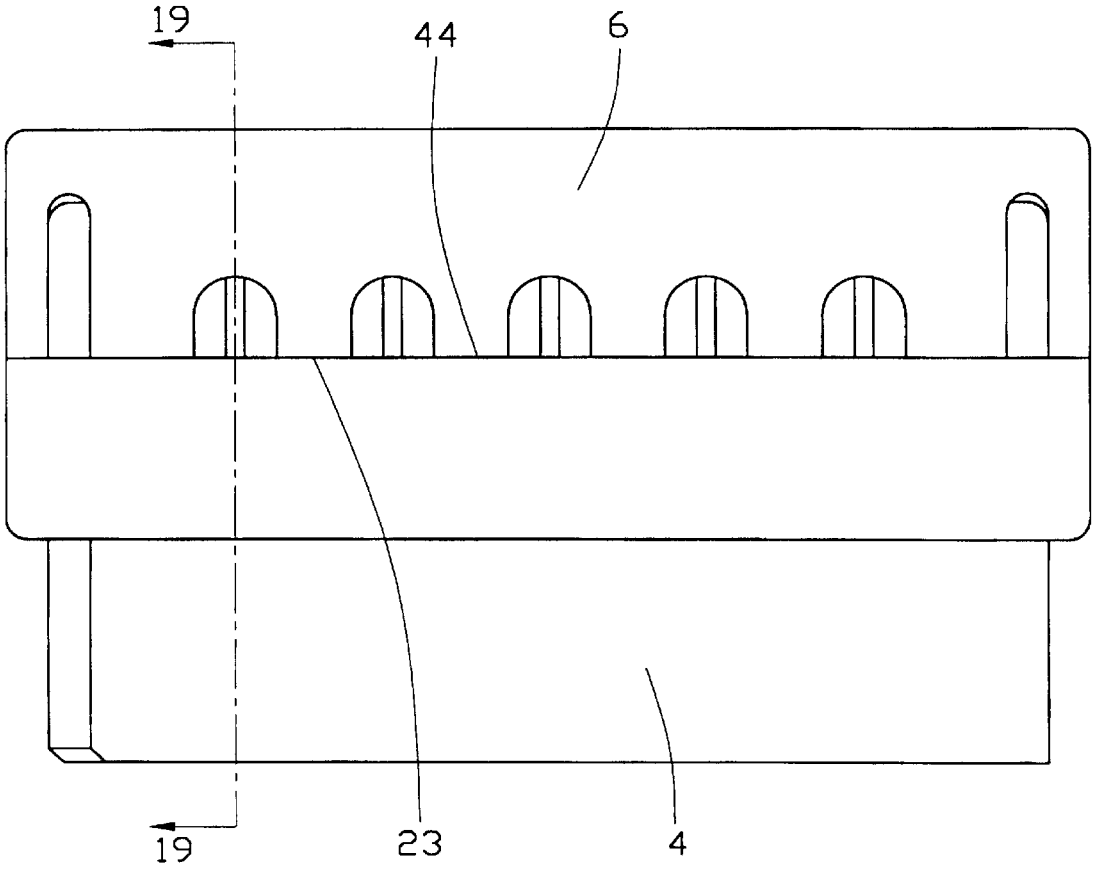
FIG. 18 is a view similar to FIG. 17 but viewed from a side.
Figure 19:
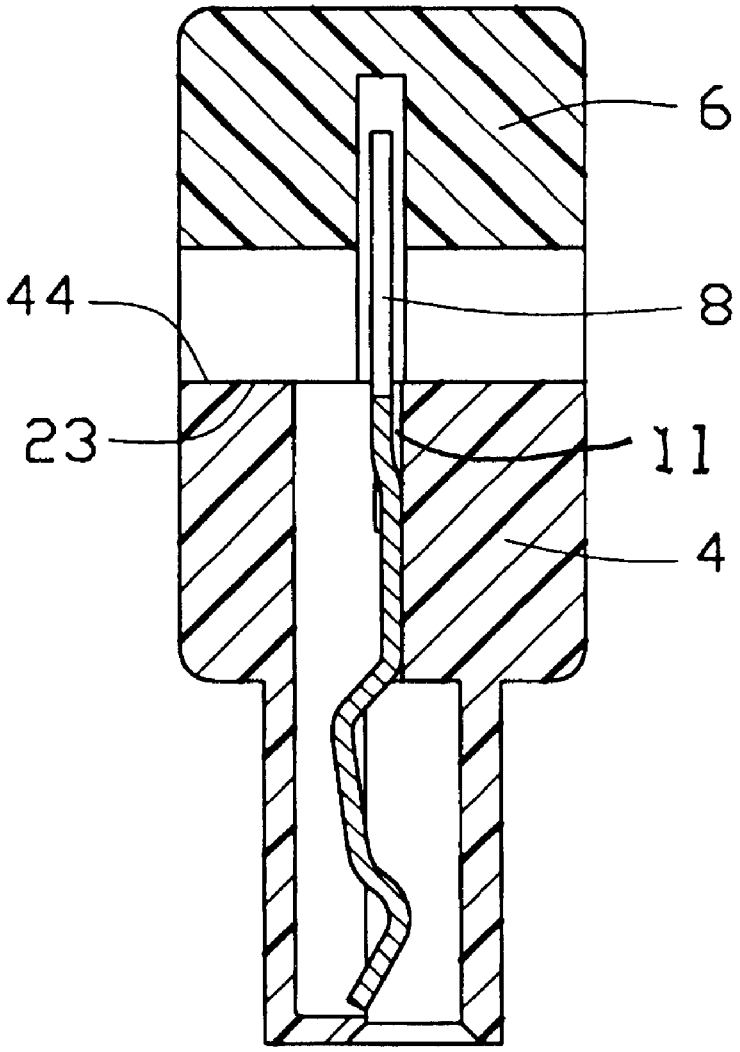
FIG. 19 is a cross-sectional view of the ID connector taken along line 19—19 shown in FIG. 18.

Referring to FIGS. 17–19, in assembly, the front beam 36 slides completely across the teeth 28, and the posts 24 are receiving in the channels 40, whereby the upper surface 23 of the base 4 overlaps or abuts the bottom surface 44 of the cover 6, and the forks 48 are completely received in the slot 45. By above process, then form the ID connector 2 in accordance with the present invention. Furthermore, the ID connector 2 can connect the wires 58 and an electronic device (not shown) by using ID (Insulation Displacement Contact) technology for transmitting power. It is understood that the connection between the wires 58 and the electronic device is very reliable, since the forks 48 are received in the slot 45 of the cover 6 and the posts 24 are received in the channels 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An insulation displacement electrical connector comprising:

an elongated base having a mating section defining a receiving space, a transverse slit, and a plurality of passageways therein, the base further having a mating surface, a first surface opposite to the mating surface, and two second surfaces positioned at both ends thereof;

a cover assembled to the base and comprising a central portion and a pair of frames positioned at both sides of the central portion, said central portion defining a slot and a third surface abutting the first surface, each frame defining a fourth surface abutting a corresponding second surface; and a plurality of terminals received in the base and each having at least an arm received in the corresponding passageway, a body received in the transverse slit, and an insulation displacement fork received in the slot;

wherein the base comprises a pair of posts extending from the mating section to the cover;

wherein a tooth projects beyond each second surface from the post and engages with the frame;

wherein a channel is defined between the frame and the central portion for receiving the post;

wherein the central portion defines a plurality of grooves;

wherein the fork and the arm are located in different planes with respect to a surface of the body;

wherein the mating section has a protrusion projecting from one end thereof, and a recess at an opposite end thereof and in communication with the receiving space.

* * * * *